US005167344A

United States Patent [19]

Van Schilt

[11] Patent Number: 5,167,344

[45] Date of Patent: Dec. 1, 1992

[54] THERMOPLASTIC PRESSURE VESSEL

[75] Inventor: Charles Van Schilt, Calgary, Canada

[73] Assignee: SAF-T-Pak Inc., Canada

[21] Appl. No.: 769,089

[22] Filed: Sep. 30, 1991

[51] Int. Cl.[5] ..... B65D 1/12

[52] U.S. Cl. ..... 220/657; 220/288

[58] Field of Search ..... 220/657, 659, 656, 288, 220/304, 582, 378; 215/341, 352, 329

[56] References Cited

U.S. PATENT DOCUMENTS

| | | | |
|---|---|---|---|
| 345,780 | 7/1886 | Griswold | 220/657 |
| 1,381,148 | 6/1921 | Westerbeck . | |
| 2,196,486 | 4/1940 | Anderson | 220/288 |
| 2,602,565 | 7/1952 | Regan | 220/29 |
| 3,128,005 | 4/1964 | Sherlock | 220/39 |
| 3,164,287 | 1/1965 | Williamson | 220/39 |
| 3,565,274 | 2/1971 | Davidson | 215/329 |
| 3,680,731 | 8/1972 | Lelyk et al. | 220/378 |
| 3,690,503 | 9/1972 | Curry | 220/656 |
| 4,367,821 | 1/1983 | Holt | 220/72 |
| 4,444,331 | 4/1984 | Lankston | 220/304 |
| 4,466,553 | 8/1984 | Zenger | 220/461 |
| 4,542,833 | 9/1985 | DeVaughn | 215/341 |
| 4,785,952 | 11/1988 | Obadia | 215/329 |

FOREIGN PATENT DOCUMENTS

| | | | |
|---|---|---|---|
| 3926820 | 2/1990 | Fed. Rep. of Germany | 220/657 |

*Primary Examiner*—Stephen Marcus

*Assistant Examiner*—S. Castellane

*Attorney, Agent, or Firm*—Davis, Bujold & Streck

[57] ABSTRACT

A thermoplastic pressure vessel consisting of a container having an exterior sidewall, a bottom and an annular top rim. An annular seal surface encircles the top rim. An annular collar extends outwardly and downwardly from the sidewall adjacent the top rim. The downward portion of the collar is spaced from and substantially parallel to the sidewall of the container such that an air cavity is formed between the collar and the sidewall. The collar has a threaded exterior surface. A closure is provided having a top with a depending annular skirt. The skirt has an upper portion of a first diameter with an interior sealing surface and a lower portion of a second diameter larger than the first diameter having a threaded interior surface. When the closure is positioned on the container the interior sealing surface of the upper portion engages the seal surface on the side of the top rim and the threaded interior surface on the lower portion of the skirt engages the threaded exterior surface on the collar to form a threaded connection thereby maintaining contact between the seal surfaces. The threaded connection is partially insulated by the air cavity from inward and outward flexing of the sidewalls of the container resulting from differentials in pressure, and is capable of limited flexion to maintain contact between the seal surfaces when such flexing occurs.

2 Claims, 2 Drawing Sheets

THERMOPLASTIC PRESSURE VESSEL

The present invention relates to a thermoplastic pressure vessel.

BACKGROUND OF THE INVENTION

It is difficult to make pressure vessels out of thermoplastic as such containers are flexible. A flexible container flexes when internal pressure differs from external pressure, which adversely effects the engagement between the container and its closure.

SUMMARY OF THE INVENTION

What is required is a thermoplastic pressure vessel with an improved capacity to withstand differentials in pressure.

According to the present invention there is provided a thermoplastic pressure vessel which is comprised of a container having an exterior sidewall, a bottom and an annular top rim. The annular top rim has a side and a top edge. The top edge defines an opening into an interior cavity. An annular seal surface is provided on the side of the top rim. An annular collar extends outwardly and downwardly from the sidewall adjacent the top rim. The downward portion of the collar is spaced from and substantially parallel to the sidewall of the container such that an air cavity is formed between the collar and the sidewall. The collar has a threaded exterior surface. A closure is provided having a top with a depending annular skirt. The skirt has an upper portion of a first diameter with an interior sealing surface and a lower portion of a second diameter larger than the first diameter having a threaded interior surface. When the closure is positioned on the container the interior sealing surface of the upper portion engages the seal surface on the side of the top rim and the threaded interior surface on the lower portion of the skirt engages the threaded exterior surface on the collar to form a threaded connection thereby maintaining contact between the seal surfaces. The threaded connection is partially insulated by the air cavity from inward and outward flexing of the sidewalls of the container resulting from differentials in pressure. The threaded connection is capable of limited flexion thereby maintaining contact between the seal surfaces when inward or outward flexing of the threaded connection occurs.

Although beneficial results may be obtained through the use of the thermoplastic pressure vessel as described, it is considered desirable to limit the range of flexion of which the collar is capable in order to guard against the threaded interior surface disengaging the threaded exterior surface. Even more beneficial results may therefore be obtained by having a plurality of ribs positioned transversely across the air cavity between the collar and the sidewall thereby limiting the flexibility of the threaded connection.

Although beneficial results may be obtained through the use of thermoplastic pressure vessel as described, there is a greater likelihood of the threaded interior surface disengaging from the threaded exterior surface when a tapered thread is used. Even more beneficial results may therefore be obtained by using a buttress style thread which is term used to describe a non-tapered style of thread.

Although beneficial results may be obtained through the use of the thermoplastic pressure vessel as described, even more beneficial results have been obtained when the top of the closure is concave. The concave top tends to assist in increasing engagement between the seal surfaces when pressure is exerted upon the top from within the interior cavity.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
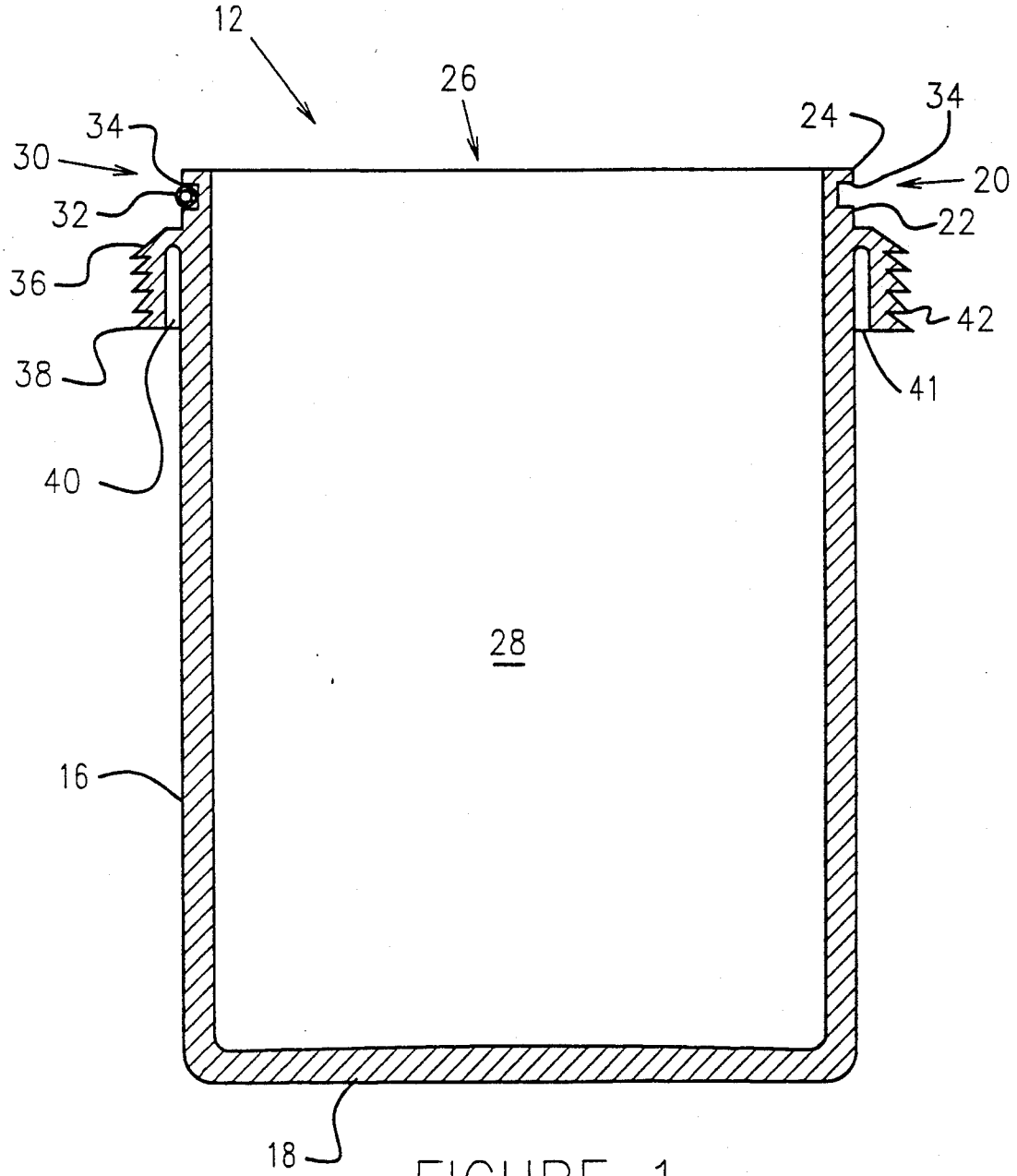
FIG. 1 is a longitudinal section view of a container constructed in accordance with the teachings of the present invention.
Figure 2:
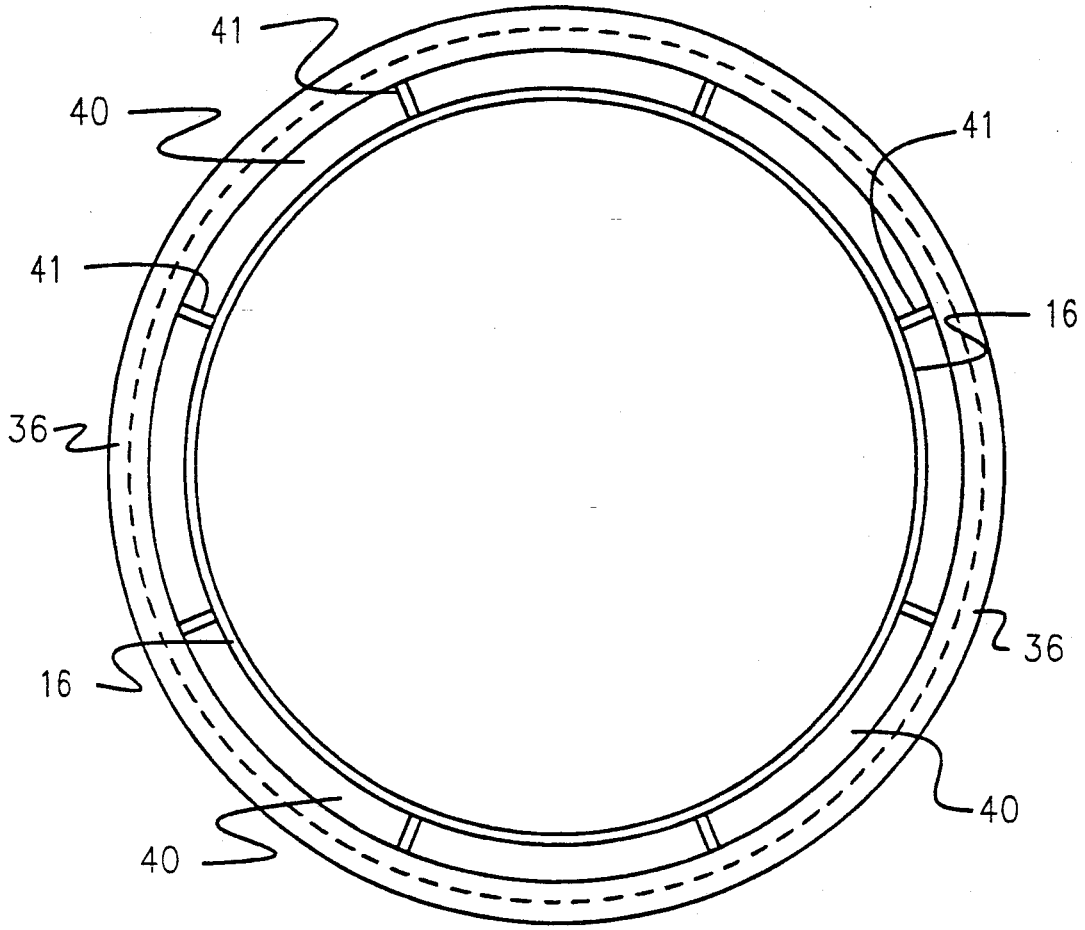
FIG. 2 is a transverse section view of the container illustrated in FIG. 1.
Figure 3:
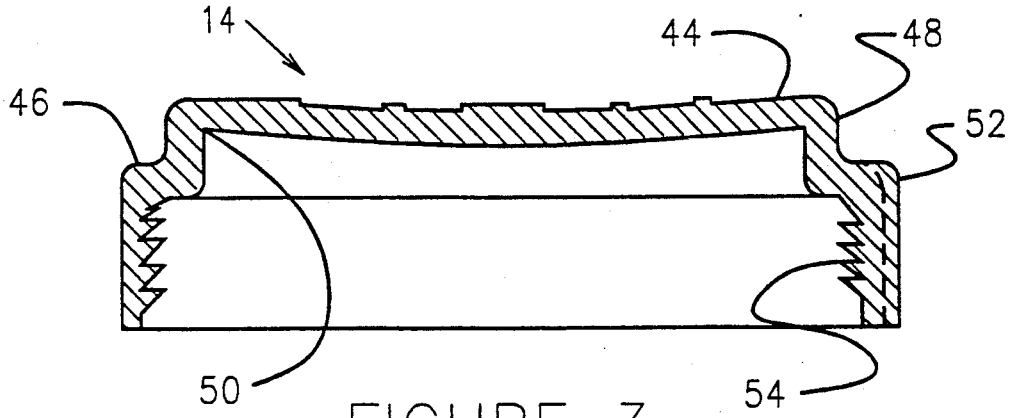
FIG. 3 is a longitudinal section view of a closure constructed in accordance with the teachings of the present invention.

The preferred embodiment, a thermoplastic pressure vessel, will now be described with reference to FIGS. 1 through 3.

The thermoplastic pressure vessel consists of two primary components; a container 12 and a closure 14. Referring to FIGS. 1 and 2, container 12 has an exterior sidewall 16, a bottom 18 and an annular top rim 20. Annular top rim 20 has a side 22 and a top edge 24. Top edge 24 defines an opening 26 into an interior cavity 28. An annular seal surface, generally indicated by reference numeral 30, is provided on side 22 of top rim 20. The form of seal selected is an O ring seal 32 which is positioned in a seal groove 34. An annular collar 36 extends outwardly and downwardly from sidewall 16 adjacent top rim 20. Collar 36 has a downward portion 38 which is spaced from and extends substantially parallel to sidewall 16 forming an air cavity 40 between collar 36 and sidewall 16. A plurality of ribs 41 are positioned transversely across air cavity 40 between collar 36 and sidewall 16. Downward portion 38 of collar 36 has a threaded exterior surface 42. Referring to FIG. 3, closure 14 has a concave top 44 with a depending annular skirt 46. Skirt 46 has an upper portion 48 of a first diameter with an interior sealing surface 50 and a lower portion 52 of a second diameter larger than the first diameter having a threaded interior surface 54.

The use and operation of the thermoplastic pressure vessel will now be described with reference to FIGS. 1 through 3. When closure 14 is positioned on container 12 interior sealing surface 50 of upper portion 48 engages O ring seal 32 on seal surface 30 on side 22 of top rim 20. Threaded interior surface 54 on lower portion 52 of skirt 46 engages threaded exterior surface 42 on collar 36 to form a threaded connection thereby maintaining contact between seal surfaces 30 and 50. The threaded connection is partially insulated by air cavity 40 from inward and outward flexing of sidewalls 16 of container 12 resulting from differentials in pressure. The threaded connection is capable of limited flexion thereby maintaining contact between seal surfaces 30 and 50 even when inward or outward flexing of the threaded connection occurs. Ribs 41 which extend across air cavity 40 between collar 36 and sidewalls 16 limit the range of flexion of which collar 36 is capable which assists in ensuring that threaded interior surface 54 does not disengage threaded exterior surface 42. Concave top 44 has a tendency to flex skirt 46 inwardly when pressure is exerted upon top 44 from within interior cavity 28. This serves to assist in increasing engagement between seal surfaces 30 and 50.

It is preferred that a buttress style thread be used as there is a greater likelihood of the threaded interior surface 54 disengaging from threaded exterior surface 42 when a tapered style of thread is used. It is also preferred that container 12 and closure 14 be made from an autoclavable thermoplastic material such as polypropylene, which increases the serviceability of the container where sterilization is desirable, but not be of relevance in some applications.

It will be apparent to one skilled in the art that modifications may be made to the illustrated embodiment without departing from the spirit and scope of the invention as defined by the claims. Exterior sidewalls 16 of container 12 are illustrated as being cylindrical; an alternate shape could be adopted, as long as top rim 20 remained annular. The sealing means selected is an O ring type of seal, but other types of seals would also be serviceable.

The embodiments of the invention in which an exclusive property or privilege is claimed are defined as follows:

1. A thermoplastic pressure vessel, comprising:

a. a container having an exterior sidewall, a bottom and an annular top rim having a side and a top edge, the top edge defining an opening into an interior cavity;

b. an annular seal surface on the side of the top rim;

c. an annular collar extending outwardly and downwardly from the sidewall adjacent the top rim, the downward portion of the collar being spaced from and substantially parallel to the sidewall of the container such that an air cavity is formed between the collar and the sidewall, the collar having a threaded exterior surface;

d. a closure having a top with a depending annular skirt, the skirt having an upper portion of a first diameter with an interior sealing surface and a lower portion of a second diameter larger than the first diameter having a threaded interior surface, such that when the closure is positioned on the container the interior sealing surface of the upper portion engages the seal surface on the side of the top rim and the threaded interior surface on the lower portion of the skirt engages the threaded exterior surface on the collar to form a threaded connection thereby maintaining contact between the seal surfaces, the threaded connection being partially insulated by the air cavity from inward and outward flexing of the sidewalls of the container resulting from differentials in pressure and the threaded connection being capable of limited flexion thereby maintaining contact between the seal surfaces when inward or outward flexing of the threaded connection occurs; and e. a plurality of ribs positioned transversely across the air cavity between the collar and the sidewall thereby limiting the flexibility of the threaded connection.

2. A thermoplastic pressure vessel, comprising:

a. a container having an exterior sidewall, a bottom and an annular top rim having a side and a top edge, the top edge defining an opening into an interior cavity;

b. an annular seal surface on the side of the top rim;

c. an annular collar extending outwardly and downwardly from the sidewall adjacent the top rim, the downward portion of the collar being spaced from and substantially parallel to the sidewall of the container such that an air cavity is formed between the collar and the sidewall, a plurality of ribs positioned transversely across the air cavity between the collar and the sidewall thereby limiting the flexibility of the threaded connection, the collar having a threaded exterior surface with a buttress style thread;

d. a closure having a concave top with a depending annular skirt, the skirt having an upper portion of a first diameter with an interior sealing surface and a lower portion of a second diameter larger than the first diameter having a threaded interior surface with a buttress style thread, such that when the closure is positioned on the container the interior sealing surface of the upper portion engages the seal surface on the side of the top rim and the threaded interior surface on the lower portion of the skirt engages the threaded exterior surface on the collar to form a threaded connection thereby maintaining contact between the seal surfaces, the threaded connection being partially insulated by the air cavity from inward and outward flexing of the sidewalls of the container resulting from differentials in pressure and the threaded connection being capable of limited flexion thereby maintaining contact between the seal surfaces when inward or outward flexing of the threaded connection occurs.

* * * * *